US007112236B2

(12) United States Patent
Hoverson et al.

(10) Patent No.: US 7,112,236 B2
(45) Date of Patent: Sep. 26, 2006

(54) MULTISTAGE SPACE-EFFICIENT ELECTROSTATIC COLLECTOR

(75) Inventors: Gregory W. Hoverson, Cookeville, TN (US); Scott P. Heckel, Stoughton, WI (US)

(73) Assignee: Fleetguard, Inc., Nashville, TN (US)

( * ) Notice: Subject to any disclaimer, the term of this patent is extended or adjusted under 35 U.S.C. 154(b) by 243 days.

(21) Appl. No.: 10/824,317

(22) Filed: Apr. 8, 2004

(65) Prior Publication Data

US 2005/0223893 A1 Oct. 13, 2005

(51) Int. Cl.
*B03C 3/36* (2006.01)

(52) U.S. Cl. ..... 95/78; 55/DIG. 19; 55/DIG. 38; 60/275; 95/79; 96/62; 96/76; 96/77; 96/97

(58) Field of Classification Search ..... 96/62, 96/76, 77, 96, 97; 95/78, 79; 55/385.3, 55/DIG. 19, DIG. 38; 60/275
See application file for complete search history.

(56) References Cited

U.S. PATENT DOCUMENTS

| | | | | | |
|---|---|---|---|---|---|
| 1,605,648 | A | | 11/1926 | Cooke | 95/79 |
| 2,085,349 | A | | 6/1937 | Wintermute | 95/69 |
| 2,114,682 | A | * | 4/1938 | Gumaer | 95/79 |
| 2,142,128 | A | * | 1/1939 | Hoss et al. | 95/79 |
| 3,569,751 | A | * | 3/1971 | Ruhnke | 310/10 |
| 3,668,835 | A | | 6/1972 | Vicard | 96/27 |
| 3,755,991 | A | | 9/1973 | Steuemagel | 96/35 |
| 3,910,779 | A | | 10/1975 | Penney | 96/66 |
| 3,985,524 | A | * | 10/1976 | Masuda | 96/32 |
| 3,999,964 | A | | 12/1976 | Carr | 96/59 |
| 4,202,674 | A | | 5/1980 | Rodenberger et al. | 96/63 |
| 4,222,748 | A | | 9/1980 | Argo et al. | 95/64 |
| 4,239,514 | A | | 12/1980 | Junkers | 96/87 |
| 4,381,927 | A | | 5/1983 | Noll | 96/69 |
| 4,478,613 | A | | 10/1984 | Brettschneider et al. | 96/61 |
| 4,713,092 | A | * | 12/1987 | Kikuchi et al. | 96/70 |
| 5,911,213 | A | | 6/1999 | Ahlborn et al. | 123/572 |
| 5,922,111 | A | * | 7/1999 | Omi et al. | 96/60 |
| 5,934,261 | A | | 8/1999 | Schumann et al. | 123/573 |
| 6,152,988 | A | * | 11/2000 | Plaks et al. | 95/58 |
| 6,221,136 | B1 | | 4/2001 | Liu et al. | 96/66 |
| 6,287,368 | B1 | * | 9/2001 | Ilmasti | 96/19 |
| 6,294,003 | B1 | * | 9/2001 | Ray | 96/49 |
| 6,348,103 | B1 | | 2/2002 | Ahlborn et al. | 134/6 |

(Continued)

FOREIGN PATENT DOCUMENTS

DE 307656 10/1919

(Continued)

OTHER PUBLICATIONS

*Mechanical Design considerations for dry precipitators*, Applied Electrostatic Precipitation, F. Knuttsen and K. R. Parker, Dec. 1997, pp. 89-112.

(Continued)

*Primary Examiner*—Richard L. Chiesa
(74) *Attorney, Agent, or Firm*—Andrus, Sceales, Starke & Sawall, LLP; J. Bruce Schelkopf

(57) ABSTRACT

A multistage space-efficient electrostatic collector cleans a gas flowing therethrough along a gas flow path having a first stage provided by a first corona discharge zone along the gas flow path, and a second stage provided by a second corona discharge zone along the gas flow path and spaced along the gas flow path from the first corona discharge zone. A method is provided for increasing residence time within the corona discharge zone of gas flowing through an electrostatic collector.

16 Claims, 3 Drawing Sheets

U.S. PATENT DOCUMENTS

| | | | | |
|---|---|---|---|---|
| 6,364,941 | B1 | 4/2002 | Liu et al. | 96/60 |
| 6,524,369 | B1 * | 2/2003 | Krigmont | 95/78 |
| 6,527,821 | B1 | 3/2003 | Liu et al. | 55/385.3 |
| 6,902,604 | B1 * | 6/2005 | Heckel et al. | 96/80 |
| 2003/0177901 | A1 * | 9/2003 | Krigmont | 95/78 |

FOREIGN PATENT DOCUMENTS

| | | | | |
|---|---|---|---|---|
| DE | 3702469 | | 8/1988 | |
| DE | 3930872 | | 3/1991 | |
| EP | 0044361 | | 1/1982 | |
| JP | 52-67074 | * | 6/1977 | 96/77 |
| JP | 53-2767 | * | 1/1978 | 96/97 |
| WO | 00/30755 | | 6/2000 | |

OTHER PUBLICATIONS

Applied Electrostatic Precipitation edited by K. R. Parker, 1997, pp. 1-8.

* cited by examiner

MULTISTAGE SPACE-EFFICIENT ELECTROSTATIC COLLECTOR

BACKGROUND AND SUMMARY

The invention relates to electrostatic collectors or precipitators, including for diesel engine electrostatic crankcase ventilation systems for blowby gas for removing suspended particulate matter including oil droplets from the blowby gas.

Electrostatic collectors or precipitators, including for diesel engine electrostatic crankcase ventilation systems, are known in the prior art. In its simplest form, a high voltage corona discharge electrode is placed in the center of a grounded tube or canister forming an annular ground plane providing a collector electrode around the discharge electrode. A high DC voltage, such as several thousands volts, e.g. 15 kV, on the center discharge electrode causes a corona discharge to develop near the electrode due to high electric field intensity. This creates charge carriers that cause the ionization of the gas in the gap between the high voltage electrode and the ground electrode. As the gas containing suspended particles flows through this region, the particles are electrically charged by the ions. The charged particles are then precipitated electrostatically by the electric field onto the interior surface of the collecting tube or canister.

Electrostatic collectors have been used in diesel engine crankcase ventilation systems for removing suspended particulate matter including oil droplets from the blowby gas, for example so that the blowby gas can be returned to the atmosphere, or to the fresh air intake side of the diesel engine for further combustion thus providing a blowby gas recirculation system.

The corona discharge electrode assembly commonly used in the prior art has a holder or bobbin with a 0.006 inch diameter wire strung in a diagonal direction. The bobbin is provided by a central drum extending along an axis and having a pair of flanges axially spaced along the drum and extending radially outwardly therefrom. The wire is a continuous member strung from back and forth between the annular flanges to provide a plurality of segments supported by and extending between the annular flanges and strung axially and partially spirally diagonally between the flanges. The inside of the drum is hollow.

The present invention provides a compact, multistage, space-efficient electrostatic collector. The present construction improves utilization of space within a package allowing for a reduction in package size or an increase in flow rating for the same package size. Effective residence time is increased by incorporating corona generation and particle collection in an inner annular passage by using the formerly unused hollow inside of the drum.

Customer requirements continue favoring smaller packaging in underhood components in internal combustion engine applications. These customer demands can be better met if all available space is used to maximum extent. The present invention not only provides better utilization of available space but also provides improved performance including within a small space-efficient package size. The improved performance is provided by increasing charged particle residence time. In one aspect, collecting zones are provided both inside and outside of the electrode drum, increasing residence time without lengthening the electrode, thus providing longer residence time, higher corona discharge efficiency, and better space efficiency. The use of both inner and outer charging and collection stages effectively increases residence time by increasing the effective length of the electrode and corona discharge zone.

DETAILED DESCRIPTION

Figure 1:
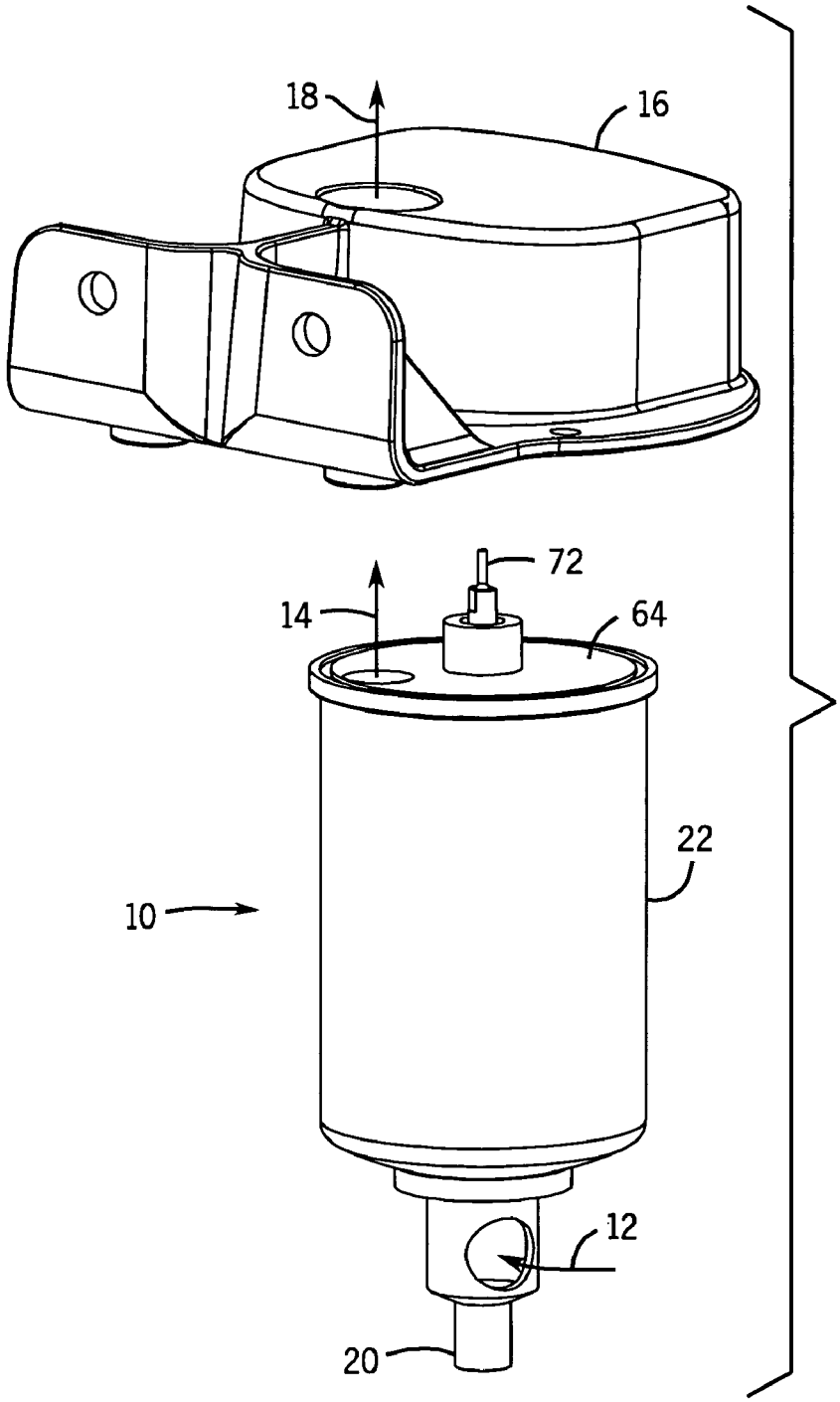
FIG. 1 is a perspective assembly view of a multistage space-efficient electrostatic collector in accordance with the invention.

FIG. 1 shows a multistage space-efficient electrostatic collector 10 for cleaning a gas flowing along a gas flow path as shown at arrows 12, 14. The collector is mountable to a mounting head 16, for example as shown in commonly owned co-pending U.S. patent application Ser. No. 10/820,541, filed on even date herewith, now U.S. Pat. No. 6,994,076, which head is mounted to an internal combustion engine, such as a diesel engine, or in the engine compartment. Particulate matter, including oil droplets from blowby gas in the case of diesel engine exhaust, flows into the collector at arrow 12 and exits at arrows 14, 18 for return to the engine or for venting to the atmosphere. Collected particulate matter including oil droplets are periodically discharged through valved outlet 20, as is known.

Figure 2:
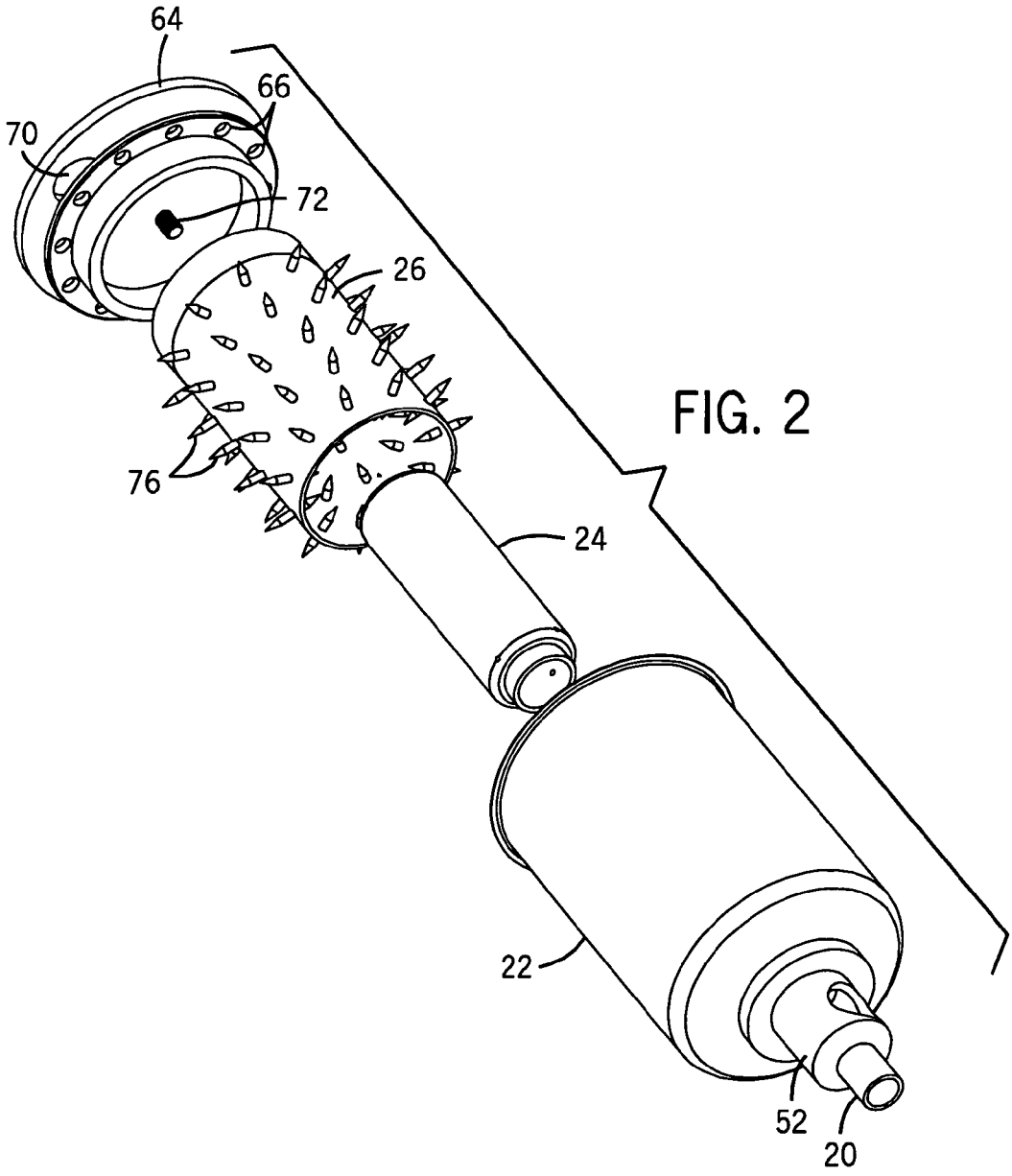
FIG. 2 is an exploded perspective view of the collector of FIG. 1.
Figure 3:
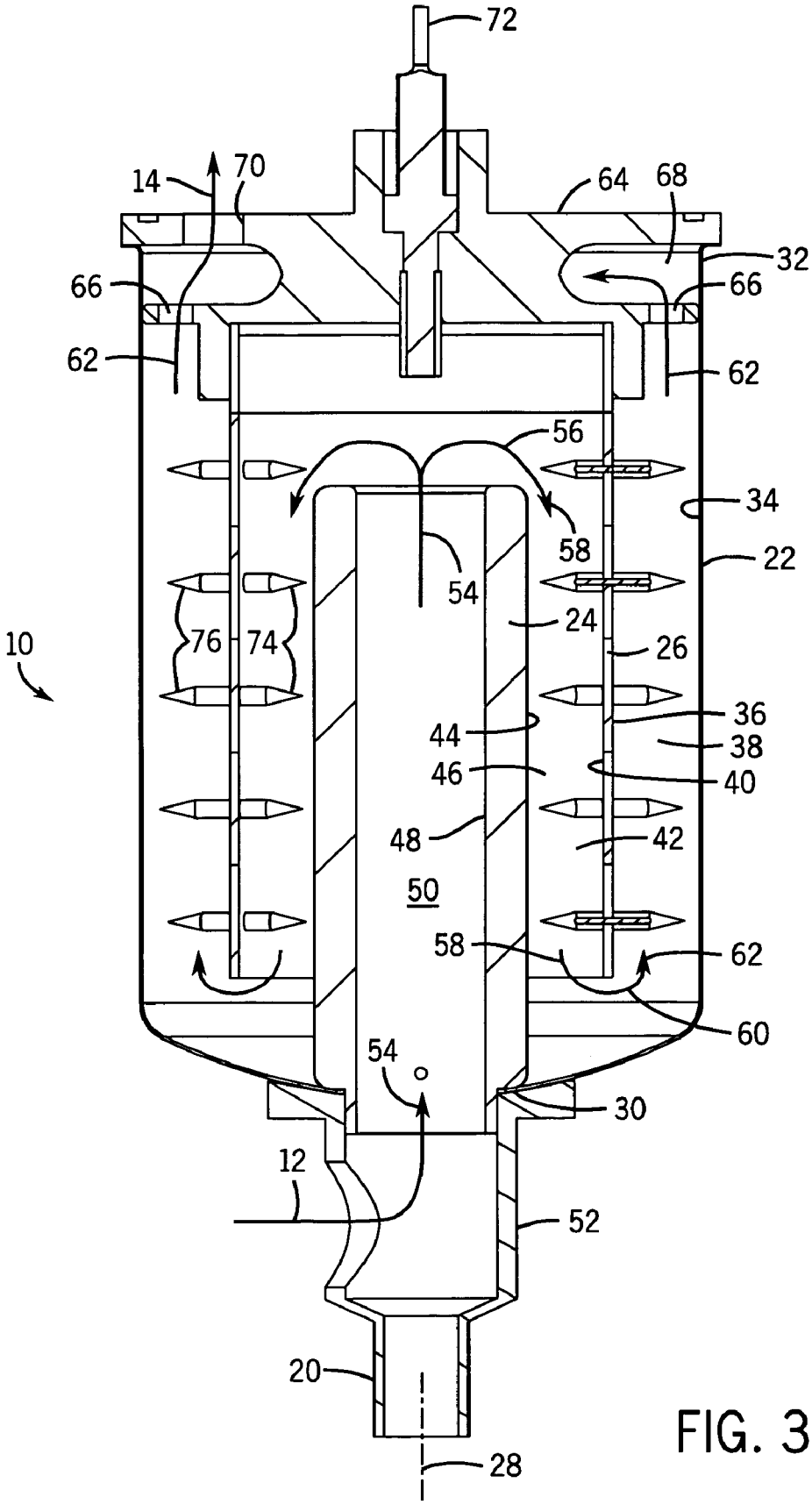
FIG. 3 is a sectional view of the collector of FIG. 1.

The collector includes an outer ground plane canister 22, FIGS. 1–3, an inner ground plane tube 24, and a corona discharge electrode 26 therebetween. Canister 22 is a cylindrical member extending axially along an axis 28, FIG. 3, between an inlet end 30 and an outlet end 32 and having an inwardly facing inner wall 34 providing a collector electrode. Corona discharge electrode 26 in the canister is provided by a hollow drum extending axially along axis 28 and having an outer wall 36 facing inner wall 34 of the canister and defining an outer annular flow passage 38 therebetween. The drum has an inner wall 40 defining a hollow interior 42. The inner ground plane 24 is provided by a hollow tubular post extending from inlet end 30 of the canister axially into the canister and axially into hollow interior 42 of drum 26. Post 24 has an outer wall 44 facing inner wall 40 of drum 26 and defining an inner annular flow passage 46 therebetween. Outer wall 44 of post 24 provides a collector electrode. The post has an inner wall 48 defining a hollow interior 50 providing an initial flow passage.

Gas to be cleaned enters inlet fitting 52 as shown at arrow 12 and flows in a first axial direction upwardly as shown at arrow 54 along a first flow path segment through the noted initial flow passage along hollow interior 50 of post 24, then turns as shown at arrow 56 and flows in a second opposite axial direction 58 along a second flow path segment through the noted inner annular passage 46 along outer wall 44 of post 24 and inner wall 40 of drum 26, and then turns as shown at arrow 60 and flows in the noted first axial direction upwardly as shown at arrow 62 along a third flow path segment through outer annular passage 38 along outer wall 36 of drum 26 and inner wall 34 of canister 22. The canister is closed at its top by an electrically insulating disk 64 having a plurality of circumferentially spaced apertures 66 providing exit flow of the gas therethrough into plenum 68 and then to outlet port 70 for exit flow as shown at arrow 14. A high voltage electrode 72 extends through disk 64 and is electrically connected to drum 26.

In the preferred embodiment, the drum has a plurality of corona discharge elements provided by a plurality of inner discharge tips 74 protruding radially inwardly into inner annular flow passage 46 toward outer wall 44 of post 24 such that inner discharge tips 74 protrude into the noted second flow path segment 58, and/or provided by a plurality of outer discharge tips 76 protruding radially outwardly into outer annular flow passage 38 toward inner wall 34 of canister 22 such that outer discharge tips 76 protrude into the noted third flow path segment 62, which discharge tips may be like those shown in commonly owned co-pending U.S. patent application Ser. No. 10/634,565, filed Aug. 5, 2003, now abandoned. Drum 26 may be a metal or other conductive member, or may be an insulator and have conductor segments therealong connected to respective tips. Outer annular flow passage 38 is concentric to and radially outward of inner annular flow passage 46. Inner annular flow passage 46 is concentric to and radially outward of initial flow passage 50. The gas flows in a serpentine path through canister 22, including a first U-shaped bend 56 between first and second flow path segments 54 and 58, and a second U-shaped bend 60 between second and third flow path segments 58 and 62.

The disclosed construction provides a multistage space-efficient electrostatic collector for cleaning the gas flowing therethrough along a gas path and includes a first stage provided by a first corona discharge zone 46 along the gas flow path, and a second stage provided by a second corona discharge zone 38 along the gas flow path and spaced along the gas flow path from the first corona discharge zone 46. The electrostatic collector is provided by a corona discharge electrode 26 and two ground planes 24 and 22. The first corona discharge zone 46 is between corona discharge electrode 26 and first ground plane 24. The second corona discharge zone 38 is between corona discharge electrode 26 and second ground plane 22. The second ground plane is provided by the noted canister 22 extending axially along axis 28. The corona discharge electrode is provided by the noted hollow drum 26 in the canister and extending axially along axis 28. The first corona discharge zone 46 is inside the drum. The second corona discharge zone 38 is outside the drum. The noted first ground plane 24 is inside the drum. Each of the corona discharge electrode 26 and the second ground plane 22 is annular, and each of the noted first and second corona discharge zones 46 and 38 is an annulus. Ground plane 22 and corona discharge zone 38 and corona discharge electrode 26 and corona discharge zone 46 are concentric. Corona discharge zone 46 concentrically surrounds ground plane 24. Corona discharge electrode 26 concentrically surrounds corona discharge zone 46. Corona discharge zone 38 concentrically surrounds corona discharge electrode 26. Ground plane 22 concentrically surrounds corona discharge zone 38. Ground plane 24 is annular and defines initial gas flow zone 50 therethrough along the gas flow path at 54 and is spaced along the gas flow path from first and second corona discharge zones 46 and 38. Ground plane 24 concentrically surrounds initial gas flow zone 50. Gas flow along the gas flow path changes direction at 60 between the first and second corona discharge zones 46 and 38. Preferably, the change of direction is 180°. Gas flow along the gas flow path flows in a flow direction 58 along first corona discharge zone 46 and then reverses direction at 60 and flows in another flow direction 62 along second corona discharge zone 38. The first and second corona discharge zones 46 and 38 are concentric to each other. Flow direction 62 is parallel and opposite to flow direction 58. Second corona discharge zone 38 surrounds first corona discharge zone 46. The gas flow path has an initial gas flow zone at 50 directing gas flow therethrough prior to gas flow through first corona discharge zone 46. The initial gas flow zone 50 is a non-corona-discharge zone. The gas flow path is a serpentine path including initial gas flow zone 50, first corona discharge zone 46, and second corona discharge zone 38. The gas flow path has a first flow reversal zone at 56 between initial gas flow zone 50 and first corona discharge zone 46, and a second flow reversal zone at 60 between first corona discharge zone 46 and second corona discharge zone 38. Gas flows in a flow direction 54 along initial gas flow zone 50, then reverses at 56 and flows in flow direction 58 along first corona discharge zone 46, then reverses at 60 and flows in flow direction 62 along second corona discharge zone 38. Flow direction 58 is parallel and opposite to flow directions 54 and 62. Initial gas flow zone 50 and first corona discharge zone 46 and second corona discharge zone 38 are concentric. Second corona discharge zone 38 surrounds first corona discharge zone 46, and first corona discharge zone 46 surrounds initial gas flow zone 50.

The invention provides a method for increasing residence time within the corona discharge zone of gas flowing through an electrostatic collector, provided by directing gas flow along a first corona discharge path 58 through zone 46 and then directing gas flow along a second corona discharge path 62 through zone 38. In the preferred method, the gas flow is directed along an initial flow path 54 through zone 50 in the electrostatic collector prior to directing gas flow along the first corona discharge path 58.

It is recognized that various equivalents, alternatives and modifications are possible within the scope of the appended claims.

What is claimed is:

1. A multistage space-efficient electrostatic collector for cleaning a gas flowing therethrough alone a gas flow path comprising a first stage comprising a first corona discharge zone along said gas flow path, and a second stage comprising a second corona discharge zone along said gas flow path and spaced along said gas flow path from said first corona discharge zone, and comprising a corona discharge electrode and two ground planes, said first corona discharge zone being between said corona discharge electrode and the first of said ground planes, said second corona discharge zone being between said corona discharge electrode and the second of said ground planes, wherein said second ground plane comprises a canister extending axially along an axis, and said corona discharge electrode comprises a hollow drum in said canister and extending axially along said axis, said first corona discharge zone being inside said drum, said second corona discharge zone being outside said drum.

2. The multistage space-efficient electrostatic collector according to claim 1 wherein said first ground plane is inside said drum.

3. A multistage space-efficient electrostatic collector for cleaning a gas flowing therethrough along a gas flow path comprising a first stage comprising a first corona discharge zone along said gas flow path, and a second stage comprising a second corona discharge zone along said gas flow path and spaced along said gas flow path from said first corona discharge zone, and comprising a corona discharge electrode and two ground planes, said first corona discharge zone being between said corona discharge electrode and the first of said ground planes, said second corona discharge zone being between said corona discharge electrode and the second of said ground planes, wherein each of said corona discharge electrode and said second ground plane is annular, and each of said first and second corona discharge zones is an annulus.

4. The multistage space-efficient electrostatic collector according to claim 3 wherein said second ground plane and said second corona discharge zone and said corona discharge electrode and said first corona discharge zone are concentric.

5. The multistage space-efficient electrostatic collector according to claim 4 wherein said first corona discharge zone concentrically surrounds said first ground plane.

6. The multistage space-efficient electrostatic collector according to claim 5 wherein said corona discharge electrode concentrically surrounds said first corona discharge zone, said second corona discharge zone concentrically surrounds said corona discharge electrode, and said second ground plane concentrically surrounds said second corona discharge zone.

7. The multistage space-efficient electrostatic collector according to claim 6 wherein said first ground plane is annular and defines an initial gas flow zone therethrough along said gas flow path and spaced along said gas flow path from said first and second corona discharge zones, and wherein said first ground plane concentrically surrounds said initial gas flow zone.

8. A multistage space-efficient electrostatic collector for cleaning a gas flowing therethrough along a gas flow path comprising a first stage comprising a first corona discharge zone along said gas flow path, and a second stage comprising a second corona discharge zone along said gas flow path and spaced along said gas flow path from said first corona discharge zone, wherein said gas flow path comprises an initial gas flow zone directing gas flow therethrough prior to gas flow through said first corona discharge zone, wherein said gas flow path is a serpentine path comprising said initial gas flow zone, said first corona discharge zone and said second corona discharge zone, wherein said gas flow path comprises a first flow reversal zone between said initial gas flow zone and said first corona discharge zone, and a second flow reversal zone between said first corona discharge zone and said second corona discharge zone.

9. The multistage space-efficient electrostatic collector according to claim 8 wherein gas flows in a first flow direction along said initial gas flow zone, then reverses and flows in a second flow direction along said first corona discharge zone, then reverses and flows in a third flow direction along said second corona discharge zone, said second flow direction being parallel and opposite to said first and third flow directions.

10. An electrostatic collector comprising a canister extending axially along an axis between an inlet end and an outlet end and having an inwardly facing inner wall providing a first collector electrode, a corona discharge electrode in said canister comprising a hollow drum extending axially along said axis and having a plurality of corona discharge elements, said drum having an outer wall facing said inner wall of said canister and defining an outer annular flow passage therebetween, said drum having an inner wall defining a hollow interior, a hollow tubular post extending from said inlet end of said canister axially into said canister and axially into said hollow interior wall of said drum, said post having an outer wall facing said inner wall of said drum and defining an inner annular flow passage therebetween, said outer wall of said post providing a second collector electrode, said post having an inner wall defining a hollow interior providing an initial flow passage, wherein gas to be cleaned flows in a first axial direction along a first flow path segment through said initial flow passage along said hollow interior of said post, then flows in a second opposite axial direction along a second flow path segment through said inner annular flow passage along said outer wall of said post and said inner wall of said drum, then flows in said first axial direction along a third flow path segment through said outer annular flow passage along said outer wall of said drum and said inner wall of said canister.

11. The electrostatic collector according to claim 10 wherein said corona discharge elements comprise a plurality of inner discharge tips protruding radially inwardly into said inner annular flow passage toward said outer wall of said post such that said inner discharge tips protrude into said second flow path segment.

12. The electrostatic collector according to claim 11 wherein said corona discharge elements further comprise a plurality of outer discharge tips protruding radially outwardly into said outer annular flow passage toward said inner wall of said canister such that said outer discharge tips protrude into said third flow path segment.

13. The electrostatic collector according to claim 10 wherein said outer annular flow passage is concentric to and radially outward of said inner annular flow passage, and said inner annular flow passage is concentric to and radially outward of said initial flow passage.

14. The electrostatic collector according to claim 13 wherein said gas flows in a serpentine flow path through said canister, including a first U-shaped bend between said first and second flow path segments, and a second U-shaped bend between said second and third flow path segments.

15. A method for increasing residence time within a corona discharge zone of gas flowing through an electrostatic collector comprising directing gas flow along a first corona discharge path in said electrostatic collector and then directing gas flow along a second corona discharge path in said electrostatic collector, and comprising directing gas flow along an initial flow path in said electrostatic collector prior to directing gas flow along said first corona discharge path, and comprising directing gas flow in a serpentine path through said electrostatic collector comprising said initial flow path, said first corona discharge path and said second corona discharge path, and comprising performing a first flow reversal between said initial flow path and said first corona discharge path, and performing a second flow reversal between said first corona discharge path and said second corona discharge path.

16. The method according to claim 15 comprising directing gas flow in a first flow direction along said initial flow path, then reversing gas flow and directing gas flow in a second flow direction along said first corona discharge path, then reversing gas flow and directing gas flow in a third flow direction along said second corona discharge path, said second flow direction being parallel and opposite to said first and third flow directions.

* * * * *